US007775041B2

(12) United States Patent
Kitamura et al.

(10) Patent No.: US 7,775,041 B2
(45) Date of Patent: Aug. 17, 2010

(54) STIRLING ENGINE

(75) Inventors: Yoshiyuki Kitamura, Yamatokoriyama (JP); Kazushi Yoshimura, Nara (JP); Kenji Takai, Yamatotakada (JP); Shinji Yamagami, Nabari (JP); Jin Sakamoto, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 453 days.

(21) Appl. No.: 11/794,839

(22) PCT Filed: Jan. 17, 2006

(86) PCT No.: PCT/JP2006/300480

§ 371 (c)(1),
(2), (4) Date: Jul. 6, 2007

(87) PCT Pub. No.: WO2006/077805

PCT Pub. Date: Jul. 27, 2006

(65) Prior Publication Data

US 2008/0282694 A1 Nov. 20, 2008

(30) Foreign Application Priority Data

Jan. 18, 2005 (JP) ..... 2005-010299

(51) Int. Cl.
*F02G 1/04* (2006.01)
*F01B 29/10* (2006.01)
*F25B 9/14* (2006.01)

(52) U.S. Cl. ..... 60/520; 60/517; 62/6; 62/520

(58) Field of Classification Search ..... 60/516–526; 62/6, 520

See application file for complete search history.

(56) References Cited

U.S. PATENT DOCUMENTS

| | | | | |
|---|---|---|---|---|
| 7,168,248 | B2 * | 1/2007 | Sakamoto et al. | 60/517 |
| 2004/0050044 | A1 * | 3/2004 | Ogura | 60/517 |
| 2004/0093873 | A1 * | 5/2004 | Ogura | 62/6 |

FOREIGN PATENT DOCUMENTS

| | | | |
|---|---|---|---|
| JP | 60-43158 | A | 3/1985 |
| JP | 2002-130853 | A | 5/2002 |
| JP | 2003-185284 | A | 7/2003 |
| JP | 2003-194430 | A | 7/2003 |

* cited by examiner

*Primary Examiner*—Thomas E Denion
*Assistant Examiner*—Christopher Jetton
(74) *Attorney, Agent, or Firm*—Birch, Stewart, Kolasch & Birch, LLP

(57) ABSTRACT

A Stirling engine, wherein the inner yoke of a linear motor is installed on the outer peripheral surface of a cylinder. To keep a proper pressure balance between a compression space on one end side of a displacer and a back pressure space on the outer peripheral side of the cylinder, a first flow passage is formed in the piston starting at the compression space side end face toward the outer peripheral surface and a second flow passage allowing the first flow passage to communicate with the back pressure space is formed in the cylinder. The second flow passage is composed of a through hole that penetrates the wall of the cylinder in a radial direction and a communication passage formed between the outer peripheral surface of the cylinder and the inner peripheral surface of the inner yoke to allow the through hole to communicate with the back pressure space.

2 Claims, 3 Drawing Sheets

STIRLING ENGINE

TECHNICAL FIELD

The present invention relates to a Stirling engine for use as a Stirling refrigeration machine, a Stirling generator unit, or the like.

BACKGROUND ART

Using helium, hydrogen, nitrogen, or the like instead of a chlorofluorocarbon as working gas, the Stirling engine has been attracting much attention as a thermal engine that does not destroy the ozone layer. In a Stirling engine for use as a refrigeration machine, a piston is reciprocated in a pressure vessel by a power source such as a linear motor, and, synchronously with the piston, a displacer is reciprocated with a predetermined phase difference kept therebetween. The piston and the displacer allow the working gas to move between a compression space and an expansion space so as to achieve a Stirling cycle (more precisely, in the case of a Stirling refrigeration machine, a reversed Stirling cycle). In the compression space, the temperature of the working gas increases due to isothermal compression; in the expansion space, the temperature of the working gas decreases due to isothermal expansion. In this way, the temperature of the compression space increases and the temperature of the expansion space decreases. Heat dissipation from the compression space (high-temperature space) via a hot heat-conducting head allows the expansion space (low-temperature space) to absorb heat from the outside via a cold heat-conducting head.

As the piston reciprocates continuously, the pressure inside a back pressure space formed around the cylinder that houses the piston gradually increases, and this upsets the pressure balance between the back pressure space and the compression space, causing the center of the reciprocation of the piston to deviate from its original position toward the compression space. This, if not dealt with, may cause the piston to reach its physical movement limit, or may cause the piston and the displacer to collide with each other.

To avoid such a situation, ingenious proposals have been made, as exemplified by the following one: a flow passage is formed in the piston so as to connect the outer circumferential sliding face of the piston to the compression space, a flow passage is formed in the cylinder so as to connect the inner circumferential sliding face of the cylinder to the back pressure space, and when the piston comes to a given position, the two flow passages communicate with each other, thereby keeping the proper pressure balance between the back pressure space and the compression space. An example of such a Stirling engine is disclosed in Patent Publication 1.

In a Stirling engine, the piston is typically driven by a linear motor. The linear motor includes an outer yoke, an inner yoke, and a permanent magnet arranged between them. In a linear motor, a permanent magnet is arranged between an outer yoke and an inner yoke; the magnetic flux density of the magnetic field produced between the outer and inner yokes is thus superposed on the magnetic flux density attributable to the permanent magnet, and the resulting unevenness in magnetic flux density produces a force that makes the piston reciprocate. The piston is coupled to the permanent magnet and thus is allowed to reciprocate. An example of a Stirling engine having such a piston-driving mechanism is disclosed in Patent Publication 2.

Patent Publication 1: JP-A-2002-130853 (pages 3 to 4, FIG. 1, FIG. 11)

Patent Publication 2: JP-A-2003-185284 (pages 2 to 3, FIG. 9)

DISCLOSURE OF THE INVENTION

Problems to be Solved by the Invention

In a structure in which a piston is driven by a linear motor, the inner yoke of the linear motor is typically fitted to the outer circumferential face of a cylinder. The inner yoke then makes it difficult to form a flow passage for keeping the proper pressure balance between a back pressure space and a compression space. The linear motor may be arranged away from the flow passage, but such an arrangement requires a longer cylinder. Disadvantageously, this increases the material and manufacturing costs of the cylinder, and also makes the Stirling engine larger. If it turns out to be necessary to elongate the piston as well as the cylinder, doing so also increases the material and manufacturing costs of the piston. Similar disadvantages also arise when a Stirling engine is used as a generator unit and the inner yoke of a generator is fitted to the outer circumferential face of the cylinder.

An object of the present invention is, in a Stirling engine structured such that the proper pressure balance between a back pressure space and a compression space is kept by allowing a flow passage formed in a piston and a flow passage formed in a cylinder to communicate with each other, to permit the inner yoke of a linear motor or of a generator to be fitted to the outer circumferential face of the cylinder without a lengthening of the cylinder.

Means for Solving the Problem

To achieve the above object, the present invention proposes a Stirling engine having a piston reciprocating in a cylinder and a displacer reciprocating with a predetermined phase difference kept relative to the piston, wherein a working gas is moved between a compression space formed at one end of the displacer and an expansion space formed at another end of the displacer, and wherein, for a purpose of keeping a proper pressure balance between a back pressure space formed outside an outer circumferential face of the cylinder and the compression space, a first flow passage is formed in the piston to run from a compression-space side end face thereof to an outer circumferential face thereof, and a second flow passage is formed in the cylinder so as to allow the first flow passage to communicate with the back pressure space when the piston comes into a predetermined position, characterized in that the second flow passage is composed of a through hole penetrating a wall of the cylinder in a radial direction and a communication passage formed between an inner yoke fitted on the outer circumferential face of the cylinder and the outer circumferential face of the cylinder.

With this structure, it is possible to fit the inner yoke on the cylinder so as to cover the through hole, and this eliminates the need to elongate the cylinder as in the case where the inner yoke is arranged away from the through hole at the cost of elongating the cylinder. Thus, no increase in the material cost and the manufacturing cost of the cylinder is involved. In addition, it is possible to avoid the elongation of the piston and the resulting increase in the material cost and the manufacturing cost of the piston. Since the cylinder and the piston do not need to be elongated, a casing (pressure vessel) of the Stirling engine does not need to be enlarged, and thus the material cost of the casing can be reduced. Moreover, the above described structure of the second flow passage does not affect the amount of gas passed therethrough, and thus the performance of the Stirling engine remains unchanged.

The present invention is also characterized in that, in the Stirling engine structured as described above, the communication passage is a groove formed in the outer circumferential face of the cylinder.

With this structure, it is possible to form the second flow passage simply by making a hole and forming a groove in the cylinder. The inner yoke is a sintered compact of a mixture of soft magnetic iron powder and resin. Compared with forming a groove in the inner yoke, forming a groove in the cylinder is easier, and permits the shape of the groove to be changed easily. This advantageously makes it easy to give the groove the optimal shape.

ADVANTAGES OF THE INVENTION

According to the present invention, for the purpose of keeping the proper pressure balance between a back pressure space and a compression space, a first flow passage is formed in the piston to run from the compression space side end face thereof to an outer circumferential face thereof, and a second flow passage is formed in the cylinder so as to allow the first flow passage to communicate with the back pressure space when the piston comes to a predetermined position. Here, the second flow passage is composed of a through hole penetrating the wall of the cylinder in the radial direction and a communication passage formed between an inner yoke fitted on the outer circumferential face of the cylinder and the outer circumferential face of the cylinder. With this structure, the cylinder does not need to be elongated as in the case where the inner yoke is arranged away from the through hole at the cost of elongating the cylinder. This makes it possible to prevent an increase in the costs of the cylinder and the piston and an enlargement of the Stirling engine.

LIST OF REFERENCE SYMBOLS

Figure 1:
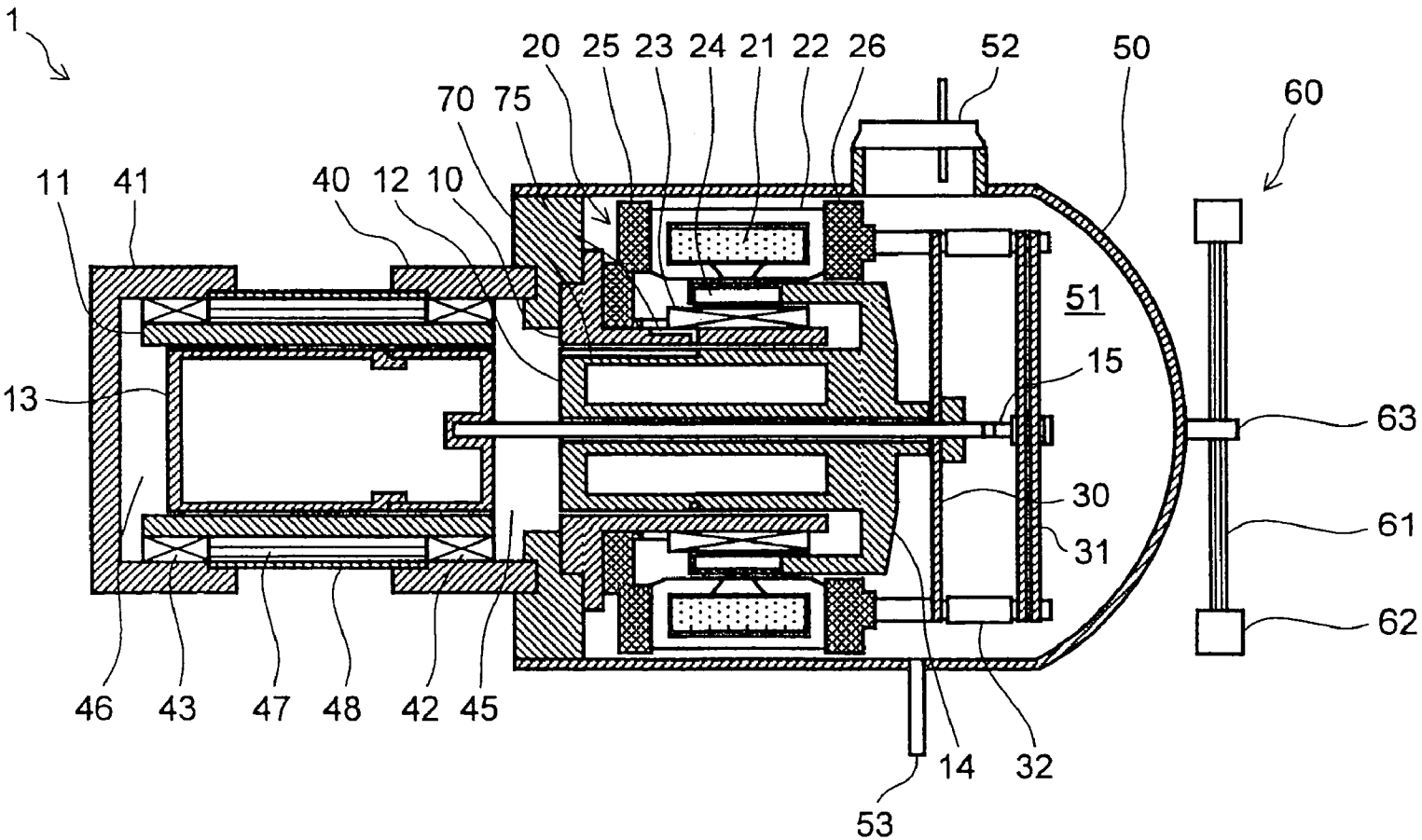
FIG. 1 A sectional view of a Stirling engine of the present invention.

1 Stirling engine
10 cylinder
12 piston
13 displacer
20 linear motor
23 inner yoke
45 compression space
46 expansion space
50 pressure vessel
51 back pressure space
70 first flow passage
75 second flow passage
76 through hole
77 communication passage

BEST MODE FOR CARRYING OUT THE INVENTION

A first embodiment of the present invention will be described with reference to FIG. 1. FIG. 1 is a sectional view of a Stirling engine. The Stirling engine is for use as a refrigeration machine.

The Stirling engine 1 is built around cylinders 10 and 11. The axes of the cylinders 10 and 11 run along the same straight line. A piston 12 is inserted into the cylinder 10 and a displacer 13 is inserted into the cylinder 11. When the Stirling engine 1 operates, the piston 12 and the displacer 13 reciprocate in the cylinders 10 and 11 without touching the inner walls of the cylinders 10 and 11, respectively, thanks to the gas bearing mechanism. The piston 12 and the displacer 13 move with a predetermined phase difference kept therebetween.

At one end of the piston 12, a cup-shaped magnet holder 14 is arranged. From one end of the displacer 13, a displacer rod 15 extends. The displacer rod 15 penetrates the piston 12 and the magnet holder 14 so as to be slidable in the axial direction.

The cylinder 10 holds a linear motor 20 outside the reciprocation space of the piston 12. The linear motor 20 includes: an outer yoke 22 having a coil 21; an inner yoke 23 located in contact with the outer circumferential face of the cylinder 10; a ring-shaped magnet 24 inserted in an annular space between the outer yoke 22 and the inner yoke 23; and end brackets 25 and 26 formed of a synthetic resin for holding the outer yoke 22 and the inner yoke 23 in a predetermined positional relationship. The magnet 24 is fixed to the magnet holder 14.

A central part of a spring 30 is fixed to a hub portion of the magnet holder 14. A central part of a spring 31 is fixed to the displacer rod 15. Peripheral parts of the springs 30 and 31 are fixed to the end bracket 26. Between the peripheral parts of the springs 30 and 31, a spacer 32 is arranged so as to keep a predetermined distance between the springs 30 and 31. The springs 30 and 31 are each a disk-shaped member having a spiral cut formed therein, and serve to make the displacer 13 resonate with the piston 12 with a predetermined phase difference (typically a phase difference of approximately 90°) kept therebetween.

Outside the part of the cylinder 11 that forms the reciprocation space of the displacer 13, heat-conducting heads 40 and 41 are arranged. The heat-conducting head 40 is ring-shaped and the heat-conducting head 41 is cap-shaped, both of which are made of a metal having high thermal conductivity such as copper, a copper alloy, or the like. The heat-conducting heads 40 and 41 are supported outside the cylinder 11 with ring-shaped inner heat exchangers 42 and 43 placed in between, respectively. The inner heat exchangers 42 and 43 are both gas-permeable and conduct the heat of the working gas passing through the interior thereof to the heat-conducting heads 40 and 41. To the heat-conducting head 40, the cylinder 10 and the pressure vessel 50 are coupled.

On one end side of the displacer 13, a compression space is formed, and on the other end side of the displacer 13, an expansion space is formed. The space enclosed with the heat-conducting head 40, the cylinders 10 and 11, the piston 12, the displacer 13, and the inner heat exchanger 42 serves as the compression space 45. The space enclosed with the heat-connecting head 41, the cylinder 11, the displacer 13, and the inner heat exchanger 43 serves as the expansion space 46.

Between the inner heat exchangers 42 and 43, a regenerator 47 is arranged. The regenerator 47 is made of a plastic film rolled into a cylindrical shape and a number of fine projections are scattered over one face of the film so as to form a gap as wide as the height of the projections between adjacent turns of the rolled film, the gap serving as a passage through which the working gas flows. The regenerator 47 is enclosed in a regenerator tube 48, whereby an air-tight passage is formed between the heat-conducting heads 40 and 41.

The linear motor 20, the cylinder 10, and the piston 12 are enclosed in the pressure vessel 50, which is cylindrical. The space around the cylinder 10 inside the pressure vessel 50 serves as a back pressure space 51. On the outer circumferential face of the pressure vessel 50, there are arranged a terminal 52 via which electric power is supplied to the linear motor 20 and a pipe 53 via which the working gas is charged into the pressure container 50. The pipe 53 is shut tight after the working gas is charged into the pressure vessel 50 to a predetermined pressure.

On an outside face of the pressure container 50, a dynamic damper 60 is fitted. The dynamic damper 60 is composed essentially of: a plate spring 61 having a plurality of thin plate springs laid over one another; and a mass 62 arranged around the periphery of the spring 61. The center of the spring 61 is fixed to a rod 63 projecting from the center of the end face of the pressure vessel 50.

The Stirling engine 1 operates as follows. When an alternating current is supplied to the coil 21 of the linear motor 20, a magnetic field is generated between the outer yoke 22 and the inner yoke 23 so as to penetrate the permanent magnet 24, causing the magnet 24 to reciprocate in the axial direction. Supplying electric power having a frequency corresponding to the resonance frequency determined based on the total weight of the piston system (the piston 12, the magnet holder 14, the magnet 24, and the spring 30) and the spring constant of the spring 30 allows the piston system to start a smooth sinusoidal reciprocating movement.

The resonance frequency of the displacer system (the displacer 13, the displacer rod 15, and the spring 31) is determined by its total weight and the spring constant of the spring 31; the resonance frequency here is set to be resonant with the drive frequency of the piston 12.

The reciprocating movement of the piston 12 allows compression and expansion to take place alternately and repeatedly in the compression space 45. With this pressure change, the displacer 13 also reciprocates. Here, due to the flow resistance between the compression space 45 and the expansion space 46 and other factors, a phase difference arises between the displacer 13 and the piston 12. Thus, the displacer 13, having a free-piston structure, reciprocates synchronously with the piston 12 reciprocates, with a predetermined phase difference kept therebetween.

Through the operations described above, a Stirling cycle (a reversed Stirling cycle) is achieved between the compression space 45 and the expansion space 46. In the compression space 45, the temperature of the working gas increases due to isothermal compression; in the expansion space 46, the temperature of the working gas decreases due to isothermal expansion. Hence, the temperature of the compression space 45 increases; the temperature of the expansion space 46 decreases.

The working gas moving between the compression space 45 and the expansion space 46 during operation gives its heat to the heat-conducting heads 40 and 41 via the inner heat exchangers 42 and 43 when it flows through the inner heat exchangers 42 and 43. The temperature of the working gas is high when it flows from the compression space 45 into the regenerator 70, and thus the heat-conducting head 40 is heated and acts as a warm head. The temperature of the working gas is low when it flows from the expansion space 46 into the regenerator 70, and thus the heat-conducting head 41 is cooled and acts as a cold head. By rejecting heat via the heat-conducting head 40 into the ambient air and decreasing the temperature of a particular space via the heat-conducting head 41, the Stirling engine 1 serves as a refrigerator engine.

The regenerator 47 does not conduct the heat in the compression space 45 to the expansion space 46 or vice versa, but simply permits the working gas to flow between them. The hot working gas that has flowed out of the compression space 45 then flows via the inner heat exchanger 42 into the regenerator 47; it then, while passing through the regenerator 47, gives heat to the regenerator 47, so that the working gas is colder when it flows into the expansion space 46. The cold working gas that has flowed out of the expansion space 46 then flows via the inner heat exchanger 43 into the regenerator 47; it then, while passing through the regenerator 47, absorbs heat from the regenerator 47, so that the working gas is hotter when it flows into the compression space 45. That is, the regenerator 47 serves as heat storage means.

As the piston 12 and the displacer 13 reciprocate and the working gas moves, the Stirling engine 1 produces vibration. This vibration is damped by the dynamic damper 60.

As the piston 10 reciprocates continuously, the pressure inside the back pressure space 51 gradually increases, and this upsets the pressure balance between the back pressure space 51 and the compression space 45, causing the center of the reciprocation of the piston 12 to deviate from its original position toward the compression space 45 side. This, if not dealt with, may cause the piston 12 to reach its physical movement limit, or may cause the piston 12 and the displacer 13 to collide with each other.

To prevent such a situation, a first return flow passage 70 is formed in the piston 12 from the compression space side end face thereof to the outer circumferential face thereof, and in the cylinder 10, a second flow passage 75 is formed so as to allow the first flow passage 70 to communicate with the back pressure space when the piston 12 comes to a predetermined position.

Figure 2:
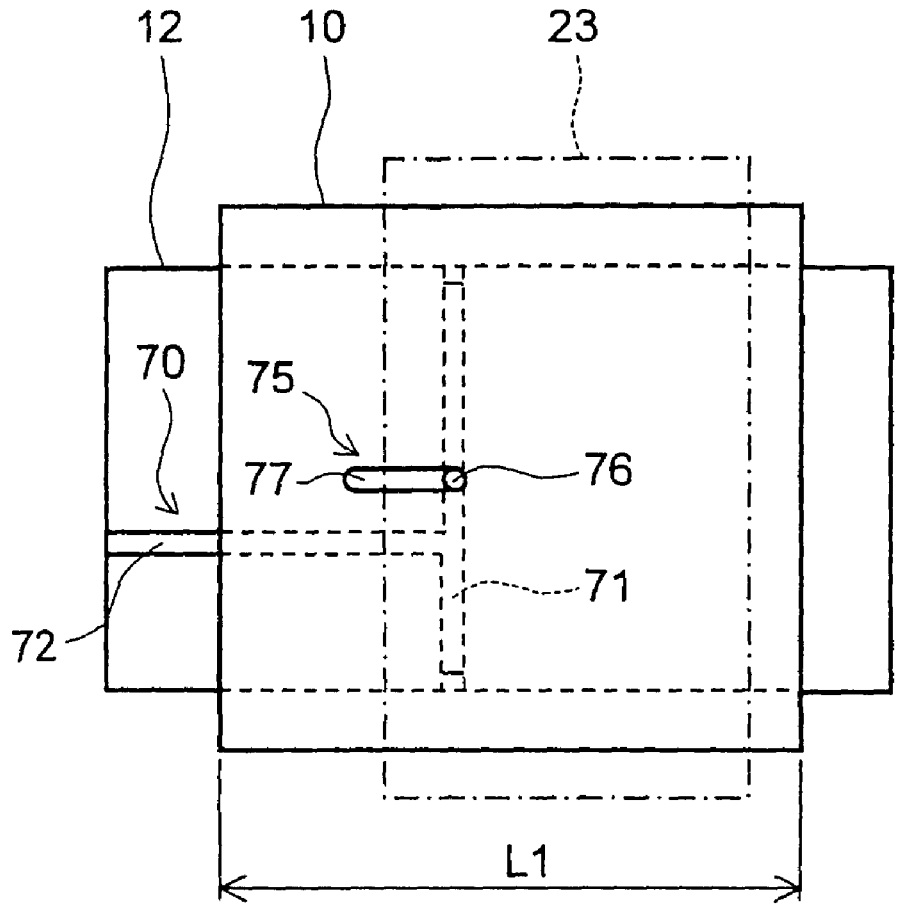
FIG. 2 A schematic plan view of a cylinder portion.

FIG. 2 is a schematic plan view of the cylinder portion, showing the structures of the first flow passage 70 and the second flow passage 75. The first flow passage 70 is composed of: an annular groove 71 formed around the outer circumference of the piston 12; and an axially extending groove 72 that allows the annular groove 71 to communicate with the compression space 45. The second flow passage 75 is composed of: a through hole 76 that radially penetrates the part of the wall of the cylinder 10 with which the inner yoke 23 overlaps; and a communication passage 77 formed between the outer circumferential face of the cylinder 10 and the inner circumferential face of the inner yoke 23 so as to allow the through hole 76 and the back pressure space 51 to communicate with each other. The communication passage 77 is a groove formed in the outer circumferential face of the cylinder 10 so as to extend along the axis of the cylinder 10; it has one end thereof connected to the through hole 76, and has the other end thereof extending beyond the inner yoke 23.

When the piston 12 reciprocates, the annular groove 71 and the through hole 76 meets at the center of the reciprocation of the piston 12. At that moment, the back pressure space 51 and the compression space 45 communicates with each other via the first flow passage 70 and the second flow passage 75, thereby keeping the proper pressure balance between the back pressure space 51 and the compression space 45 as observed when the piston 12 is positioned at the center of its reciprocation.

Since the communication passage 77 is a groove, the second flow passage 75 can be formed simply by forming a hole and a groove in the cylinder 10. The inner yoke 23 is a sintered compact of a mixture of soft magnetic iron powder and resin. Compared with forming a groove in the inner yoke 23, forming a groove in the cylinder 10 is easier, and that permits the shape of the groove to be changed easily. This advantageously makes it easy to give the groove the optimal shape.

Figure 3:
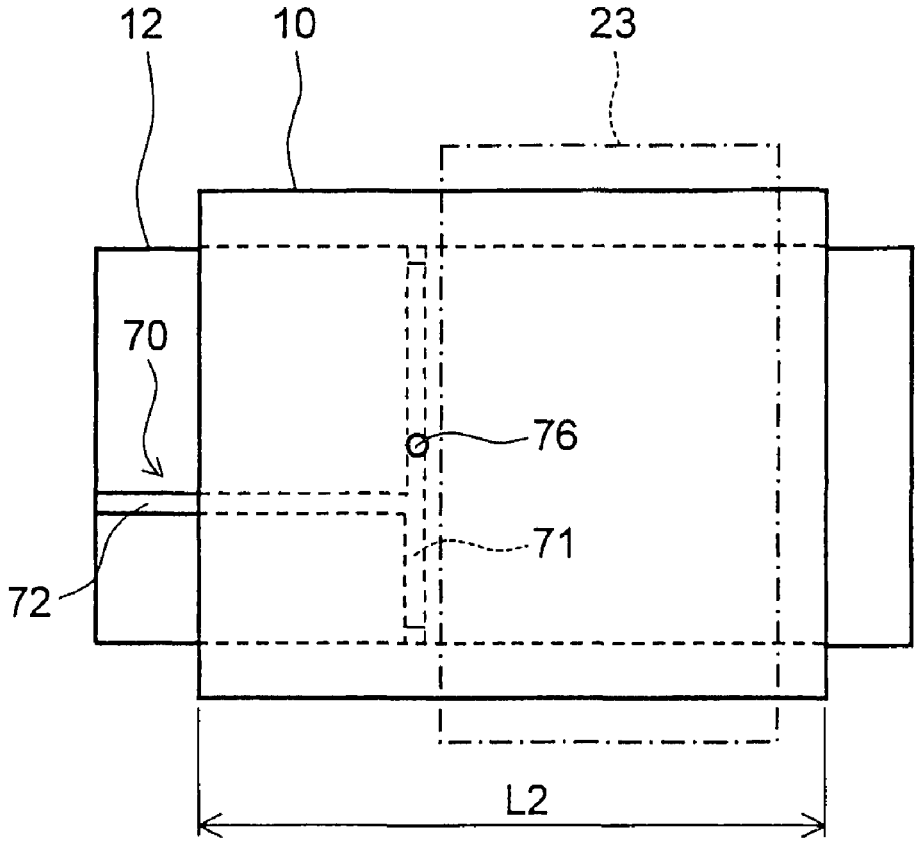
FIG. 3 A schematic plan view of a cylinder portion to which the present invention is not applied.

FIG. 3 is a schematic plan view of a cylinder portion to which the present invention is not applied. The figure shows an example in which the linear motor 20 is arranged away from the through hole 10 so that the inner yoke 23 does not cover the through hole 10 formed in the cylinder 10. In this structure, the length L2 of the cylinder 10 is larger than the length L1 of the cylinder 10 shown in FIG. 2. This increases the material cost and the manufacturing cost of the cylinder 10. In addition, the piston 12 as well as the cylinder 10 needs to be elongated, and this increases the material cost and the manufacturing cost of the piston 12. In addition, the size of the Stirling engine 1 as a whole becomes larger.

In contrast, when the structure of the present invention is adopted, since the inner yoke 23 can be fitted on the cylinder 10 so as to cover the through hole 76, the cylinder does not need to be elongated as in the case where the inner yoke 23 is arranged away from the through hole 76 at the cost of elongating the cylinder 10. Thus, no increase in the material cost and the manufacturing cost of the cylinder 10 is involved. In addition, it is possible to avoid the elongation of the piston and resulting increase in the material cost and the manufacturing cost of the piston 12. Since the cylinder 10 and the piston 12 do not need to be elongated, the pressure vessel 50 does not need to be enlarged, and thus the material cost of the pressure vessel 50 can be reduced. Moreover, the above described structure of the second flow passage 75 does not affect the amount of gas passed therethrough, and thus the performance of the Stirling engine 1 remains unchanged.

It is to be understood that the present invention may be carried out in any other manner than specifically described above as an embodiment, and many modifications and variations are possible within the scope of the present invention. For example, although the Stirling engine of the above described embodiment is a Stirling refrigeration machine, the present invention can be applied to any Stirling generator unit in which the inner yoke of a generator is fitted to the outer circumferential face of the cylinder.

INDUSTRIAL APPLICABILITY

The present invention is applicable to Stirling engines in general in which an inner yoke of a linear motor or of a generator is fitted to the outer circumferential face of a cylinder.

The invention claimed is:

1. A Stirling engine comprising: a piston reciprocating in a cylinder; and a displacer reciprocating with a predetermined phase difference kept relative to the piston, wherein a working gas is moved between a compression space formed at one end of the displacer and an expansion space formed at another end of the displacer, and wherein, for a purpose of keeping a proper pressure balance between a back pressure space formed outside an outer circumferential face of the cylinder and the compression space, a first flow passage is formed in the piston to run from a compression-space side end face thereof to an outer circumferential face thereof, and a second flow passage is formed in the cylinder so as to allow the first flow passage to communicate with the back pressure space when the piston comes into a predetermined position, wherein the second flow passage is composed of a through hole penetrating a wall of the cylinder in a radial direction and a communication passage formed between an inner yoke fitted on the outer circumferential face of the cylinder and the outer circumferential face of the cylinder.

2. The Stirling engine of claim 1, characterized in that the communication passage is a groove formed in the outer circumferential face of the cylinder.

* * * * *